United States Patent [19]

Wack et al.

[11] 4,028,511

[45] June 7, 1977

[54] FLUID JACK WITH BUILT-IN PISTON OPERATED SWITCH

[76] Inventors: Andre Wack, 14 Rue Jules Verne, Sens; Robert Bezicot, 48 Rue Joseph Fouriaux, Antony; André Cosset, 5 Rue Claude Lebret, Gournay sur Marine, all of France

[22] Filed: June 16, 1975

[21] Appl. No.: 587,049

[52] U.S. Cl. ..... 200/82 R; 200/82 C; 200/302; 200/330

[51] Int. Cl.² ..... H01H 35/38

[58] Field of Search ..... 200/302, 329, 330, 83 J, 200/153 T, 82 R, 82 C

[56] References Cited

UNITED STATES PATENTS

| | | | |
|---|---|---|---|
| 3,118,030 | 1/1964 | Palen | 200/82 C |
| 3,334,204 | 8/1967 | Brenny | 200/82 R |
| 3,414,693 | 12/1968 | Watson | 200/302 |
| 3,808,389 | 4/1974 | Ramsay | 200/302 |
| 3,928,742 | 12/1975 | Rule | 200/302 |

FOREIGN PATENTS OR APPLICATIONS

| | | | |
|---|---|---|---|
| 1,187,708 | 2/1965 | Germany | 200/82 C |

*Primary Examiner*—Gerald P. Tolin
*Attorney, Agent, or Firm*—Diller, Brown, Ramik & Wight

[57] ABSTRACT

A pneumatic jack for electric welding comprises a cylinder which houses a piston the connecting rod of which is connectable with an electrode. The piston rod is movable between a retracted and an extended position and at the closed end of the cylinder an electric switch is located in a recess and is embedded in electrically insulating material. The switch is provided with an operating rod which extends into a passage effecting communication between the bottom of the recess and the interior of the cylinder and which operates the switch when the piston in the cylinder is in the retracted position thereof.

5 Claims, 3 Drawing Figures

FLUID JACK WITH BUILT-IN PISTON OPERATED SWITCH

BACKGROUND OF THE INVENTION

1. Field of the Invention

This invention relates to a jack and particularly to a pneumatic jack for electric welding of the kind which comprises a cylinder housing a piston having a piston rod provided with a nose formed by an extension outside the cylinder and adapted to receive one end of an electrode carrier, the other end of which is intended to receive a welding electrode.

2. Description of the Prior Art

Jacks of the above mentioned kind, which are disposed on a frame, are more particularly intended for effecting the spot welding of metal sheets movable along a predetermined path.

Experience has shown that after the welding the electrode may remain adhering to the workpiece because the rising movement of the jack is intentionally limited.

In arrangements known at the present time no means are provided for verifying that the piston rod of the jack and consequently the electrode are actually in the top position before movement of the workpiece from one position to the next is initiated.

It follows that if this movement takes place while an electrode is still adhering to the workpiece, the movement gives rise to damage to the piston rod, and the jack must then be taken out of service.

If this should occur, it is indispensable that the jack should be replaced, thus giving rise to serious disturbances in the production cycle.

It is an object of the invention to overcome these disadvantages and to this end provides a jack with a monitoring device which is particularly simple to use and extremely effective.

SUMMARY

According to the invention there is provided a jack, particularly a pneumatic jack for electric welding, comprising a cylinder in which at least one piston carried by a piston rod is movable between a retracted position and an extended position, wherein an electrical switch located at one end of the cylinder is provided with an operating rod which extends into a passage provided in said one end of the cylinder to be actuated by the piston rod when the latter is in the retracted position thereof, and sealing means are interposed between the switch and the interior of the cylinder.

In one embodiment of the invention the switch is located in a recess in said one end of the cylinder and the operating rod is located in said passage which extends from the bottom of the recess into the cylinder, the operating rod normally projecting into the cylinder.

With an arrangement of this kind, whose simplicity of construction will be realized, the risk of damage to the jack in the manner previously mentioned is eliminated because the movement of the workpiece cannot be initiated unless the piston rod has returned to the retracted position and made contact.

It should be noted that a plurality of jacks are generally provided for the purpose of making a corresponding number of spot welds. In this case it is obvious that the electrical installation will be so arranged that the movement of the workpiece will be started only if all the switches associated with the jacks have been operated.

Absolute safety in operation is thus ensured, the movement of the workpiece being prevented until all the jacks are in the retracted position.

In one embodiment the switch is located in a recess in said one end of the cylinder and is embedded in electrically insulating material, the operating rod extends into said passage which extends from the bottom of the recess into the cylinder, and the operating rod is connected to a piston which is movable in the passage, which includes a member which extends into the cylinder, and is arranged to constitute a transmission means and a sealing means.

According to another embodiment the switch is located in a recess in said one end of the cylinder and is embedded in electrically insulating material, said passage extends from the bottom of the recess into the cylinder, and an elastic sleeve housed in said passage has an end portion which engages the operating rod and an opposite end portion which effects contact with the position.

DESCRIPTION OF THE PREFERRED EMBODIMENTS

Figure 1:
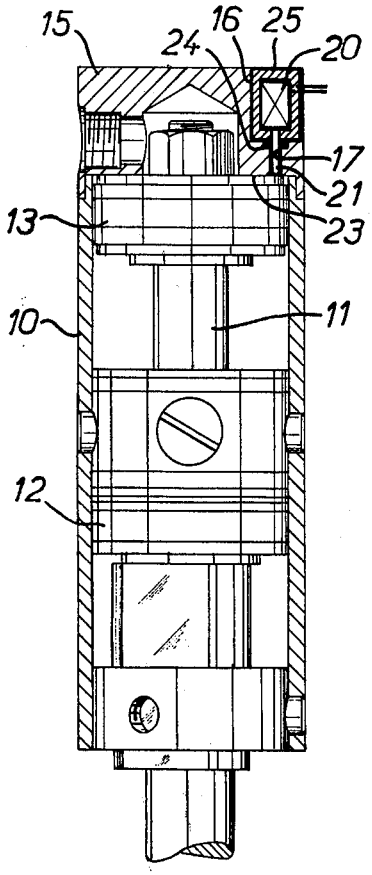
FIG. 1 is a view in elevation, partly in section, of a jack according to the invention.

In the embodiment illustrated in FIG. 1, a pneumatic jack comprises, in known manner, a cylinder 10 in which front and rear pistons 12 and 13 respectively are carried by a piston 11 for movement between a retracted position and an extended position.

The means of controlling the piston rod will not be described here, because they are similar to those described in French Pat. No. 2,076,659 of 22nd January, 1970, in the name of Ste. CEDIMAS, which patent describes a pneumatic jack for electric welding.

The cylinder 10 is open at one end and closed at the other by an end portion 15.

The end portion 15 is provided with a recess 16 which is accessible from outside and is extended at the bottom by a passage 17 leading to the interior of the cylinder.

The recess is intended to receive an electrical switch 20 which is provided with an operating rod 21 which is located in the passage 17 and has its free end projecting out of the inside face 23 of the end portion into the cylinder. The switch 20 is electrically connected to a device, not shown, and is arranged to control the movement of a workpiece when the piston 13 is in the retracted position thereof.

Sealing between the interior of the cylinder 10 and the switch 20 is provided by an insulating packing 24 which encircles the operating rod 21, and by an electrically insulating covering 25 on the switch, which covering may be of any suitable material.

Figure 2:
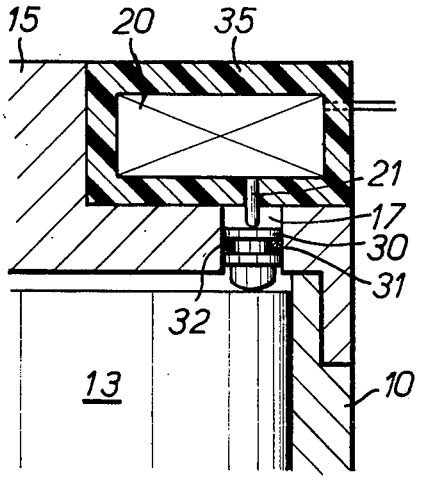
FIGS. 2 and 3 show to an enlarged scale, and in vertical section modified embodiments of the jack.

In the modified embodiment illustrated in FIG. 2 the passage 17 houses a piston 30 provided with a groove 31 for a seal 32. The bottom face of the piston 30 is intended to cooperate with the piston 13 of the jack, while the other face is in contact with the rod 21 of the switch. In an arrangement of this kind the piston 13 simultaneously provides sealing between the interior of the cylinder 10 and the switch 20 and operates the rod 21 of the switch. As in the embodiment of FIG. 1 the switch 20 is embedded in a covering 35 of electrically insulating material 35.

Figure 3:
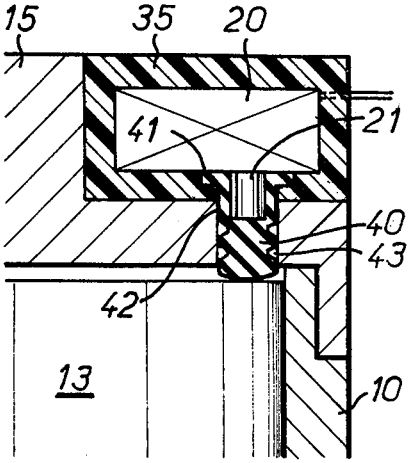

In the modified embodiment shown in FIG. 3, an elastic sleeve 40 is placed in the passage 17, one end portion of the sleeve being adapted to cap the rod 21 of the switch 20 and the other end portion projecting into the interior of the cylinder 10. The elastic sleeve, which for example may be of rubber, has an end collar 41 which is locatable in recess provided in the insulating material 35, followed by a smooth-surfaced cylinder portion 42, which in turn is followed by a series of peripheral grooves 43. The switch 20, as well as the collar 41 of the sleeve 40, is embedded in an electrical insulating material 35.

It should be observed that in the embodiments shown in FIGS. 2 and 3, the sealing means have two functions, namely;

a. to actuate the operating rod of the switch; and b. to provide sealing and electrical insulation between the piston and the jack cylinder.

With arrangements of this kind the monitoring of the upward movement of the piston rod is effected in a practical and reliable manner without in any way impairing the sealing of the jack.

It is to be understood that arrangements according to the invention may be applied to all types of jack disposed in a continuous cycle installation.

We claim:

1. The combination of a fluid jack of the type including a cylinder, a piston mounted on a piston rod movable in said cylinder along a path of movement between a retracted and an extended position, and end closure member closing said cylinder at one of its ends and having a recess opening to the exterior of said jack, said piston having an end face opposing said end closure member, a longitudinal passage extending through said end closure member from a transverse bottom wall of said recess to the interior of said cylinder; an electrical switch unit operable in response to movement of said piston to a position adjacent said end closure member, said switch unit being disposed substantially entirely inside said recess and embedded in electrical insulating material, said switch unit having an operating member extending beyond the embedding electrical insulating material, and a combined sealing and motion transmission member formed at least in part of electrical insulating material and in direct sealing contact with the wall of said passage for sealingly separating said switch unit from the interior of said cylinder, said combined sealing and motion transmission member normally projecting into the path of movement of said piston and in operative engagement with said operating member to actuate said switch unit when said piston end face comes into engagement with said sealing and motion transmission member and wherein said electrical insulating material is circumjacent said operating member along a substantial portion of its length.

2. A jack according to claim 1 wherein said sealing and transmission member comprises a piston member with a pair of spaced collars, an O-ring between said collars and engaging the wall of said longitudinal passage, and a rounded end remote from said operating member adapted to contact said piston end.

3. A jack according to claim 1, wherein said sealing and transmission member is of integral construction of elastic electric insulating material, substantially surrounding said operating member and filling said passage from said switch unit and normally projecting into the interior of said cylinder.

4. A jack according to claim 1, wherein said combined sealing and motion transmission member has a collar received in a corresponding recess in said insulating material in which said switch unit is embedded.

5. A jack according to claim 4, wherein said combined sealing and motion transmission member has a smooth cylindrical surface next to said collar, and adjacent to but spaced from said collar at least one annular rib defining an annular groove to each side thereof.

* * * * *